United States Patent [19]

Aikins

[11] Patent Number: 4,805,676

[45] Date of Patent: Feb. 21, 1989

[54] AUTOMATIC WHOLE AND MULTIPLE TREE FIREWOOD/HOG FUEL PROCESSOR

[76] Inventor: Warren A. Aikins, 3489 Indian Creek Dr., Longview, Wash. 98632

[21] Appl. No.: 155,961

[22] Filed: Feb. 16, 1988

[51] Int. Cl.[4] ..... B27L 7/00

[52] U.S. Cl. ..... 144/3 K; 144/193 A; 144/193 E; 144/246 F; 144/366; 144/367; 144/356

[58] Field of Search ..... 144/3 K, 193 R, 193 A, 144/193 E, 366, 356, 246 F

[56] References Cited

U.S. PATENT DOCUMENTS

| | | | |
|---|---|---|---|
| 3,624,756 | 11/1971 | Mellgren | 144/246 F |
| 3,955,765 | 5/1976 | Gaitten | 144/162 R |
| 4,353,401 | 10/1982 | Schilling | 144/193 E |
| 4,483,379 | 11/1984 | Aikins, et al. | 144/366 |
| 4,510,981 | 4/1985 | Biller | 144/246 F |

*Primary Examiner*—W. Donald Bray
*Attorney, Agent, or Firm*—Lee R. Schermerhorn

[57] ABSTRACT

An adjustable infeed ramp supports the input end of a main frame at a height to tilt the main frame to correspond to the inclination of a log in process. Pulled into the machine by a winch line, the leading end of the log is gripped by vertical feed rolls on a pair of side squeeze arms, a horizontal feed roll on a top squeeze arm and then by a horizontal top feed roll of hourglass shape just ahead of a vertical transverse shear blade. In a first operation the shear blade cuts less than entirely through the log and then moves away from the input end of the main frame, sliding the log, assisted by the feed rolls, farther into the machine. This movement pushes the leading end of the log through an adjustable splitter head assembly capable of splitting the leading end portion into two, three or six pieces, as desired. A second operation of the shear blade cuts off the leading end of the log and the shear blade returns back along the main frame to its starting position to repeat the cycle on another section of the log.

20 Claims, 10 Drawing Sheets

FIG. 1
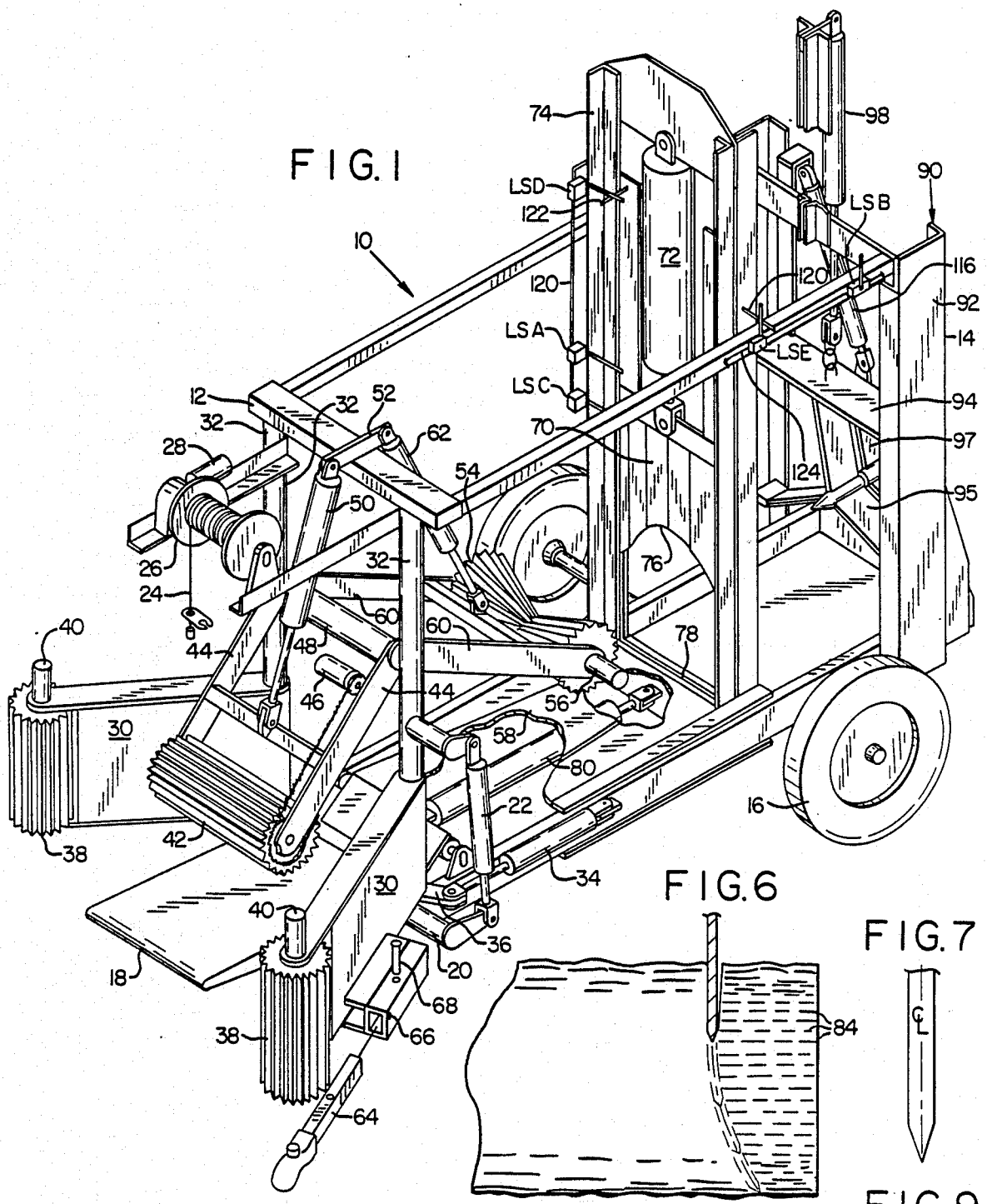
FIG. 6
FIG. 7
FIG. 8
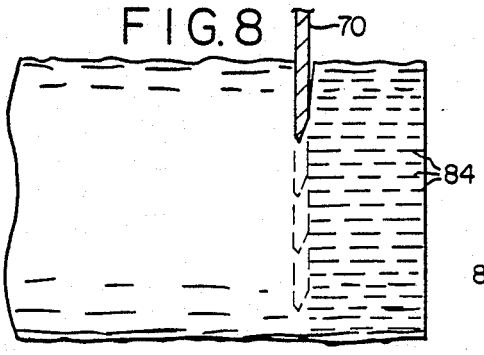
FIG. 9
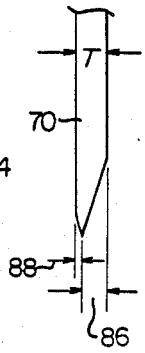

AUTOMATIC WHOLE AND MULTIPLE TREE FIREWOOD/HOG FUEL PROCESSOR

BACKGROUND OF THE INVENTION

This invention relates to improvements in the wood/-log processing machine described in U.S. Pat. No. 4,483,379.

In the machine described in said patent a shear blade transverse to the log, mounted for vertical movement in a vertical shear blade frame, first cuts less than entirely through the log and then moves rearward to pull the log farther into the machine. When splitting is desired, each such rearward movement of the shear blade frame pushes the leading end portion of the log through a splitter. Then the shear blade completes its downward movement to cut off the leading end of the log, the shear blade retracts upward, and then the shear blade frame retracts to a start position to repeat the operation on the next leading end portion of the log.

As the log is thus drawn into the machine step-by-step, vertical knife edges on a pair of lateral arms shear off side branches and a horizontal knife edge on a top arm shears off top branches.

The main frame of the machine is inclined to correspond to the inclination of the incoming log by raising or lowering the machine output end support on a pair of wheels, while the input end is supported at fixed elevation by an infeed ramp resting on the ground. Each log is started into the machine by a power operated grapple which pulls the log in far enough for its first engagement by the shear blade, after which all further infeed movements are accomplished by the shear blade as described above.

SUMMARY OF THE INVENTION

In the present construction, the adjustment of the inclination of the main frame to correspond to the inclination of a log in process is accomplished by raising or lowering a vertically adjustable infeed ramp on the front end of the machine. The log and any branches thereon are gripped between vertical feed rolls on opposite side squeeze arms, a horizontal feed roll on a top squeeze arm, and then by a horizontal top feed roll of hourglass shape just ahead of the shear blade. All four of these feed rolls are power driven to assist the feed movement exerted by the rearward movement of the shear blade carriage.

The shear blade is corrugated for greater stiffness and its cutting edge is arched to center a log or group of logs on the shear blade anvil. Most of the bevel on the cutting edge is on the output side of the blade to prevent the blade from bending toward the short end of the log when short lengths of log are being cut off.

The splitter head is adjustable to split a log into two, three or six pieces as desired, depending on the size of the log. This is accomplished by mounting a rotatable three blade splitter behind a non-rotatable three blade splitter, both splitters being vertically adjustable.

The invention will be better understood and additional features and advantages will become apparent from the following description of the preferred embodiment illustrated in the accompanying drawings. Various changes may be made in the details of construction and arrangement of parts and certain features may be used without others. All such modifications within the scope of the appended claims are included in the invention.

BRIEF DESCRIPTION OF THE DRAWINGS

FIG. 1 is an isometric view of a machine embodying the invention;

FIG. 6 illustrates the shearing action of a conventional shear blade;

FIG. 7 is an enlarged view of the shear blade in FIG. 6 showing the conventional shape of bevel on its cutting edge;

FIG. 8 is a view similar to FIG. 6 showing the cutting action of the present shear blade;

FIG. 9 is an enlarged view illustrating the shape of bevel on the cutting edge of the shear blade in FIG. 8;

DESCRIPTION OF THE PREFERRED EMBODIMENT

Figure 2:
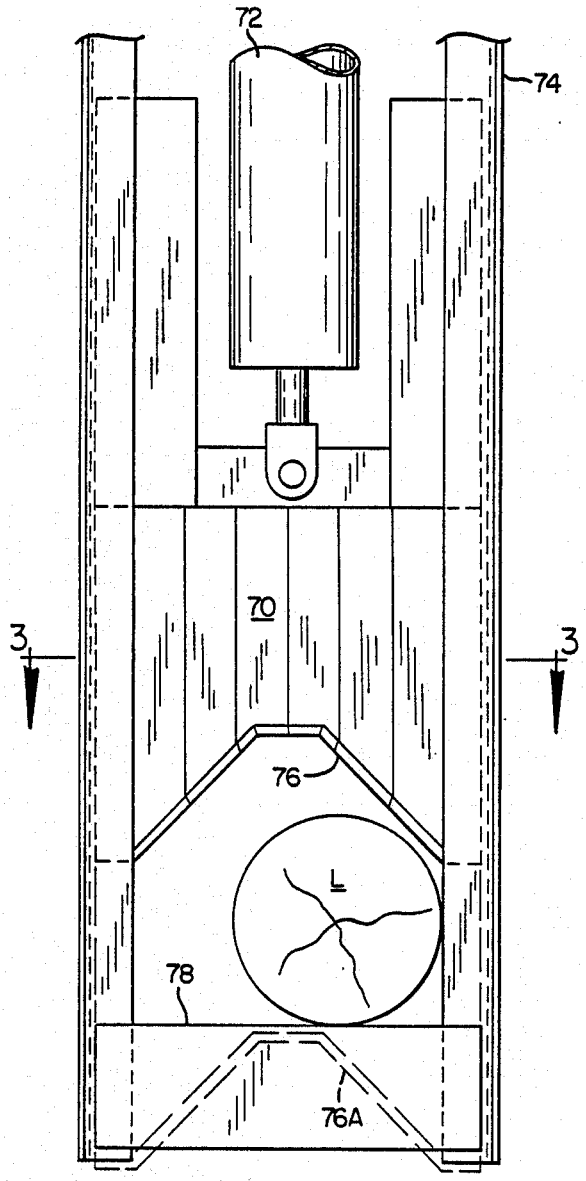
FIG. 2 is a front elevation view of the shear blade and shear blade carriage in FIG. 1 showing a different shape of shear blade.

As seen in FIG. 1 an elongated main frame 10 has a front or infeed end 12 and a rear or outfeed end 14. Outfeed end 14 is supported at a constant height above the ground level by a pair of rear wheels 16, while the infeed end 12 may be raised or lowered by an adjustable infeed ramp plate 18 mounted on a transverse horizontal shaft 20, which may be rotated through a small angle by a piston rod in hydraulic cylinder 22. This allows the main frame to be tilted to approximately the vertical angle of a log in process as the leading end of the log is raised a short distance above ground level as it enters the machine.

The leading end of a log lying on the ground is pulled over infeed ramp 18 by a winch cable 24 having a knob and choker bell to slide the log on the ground. The winch cable is retracted by a winch drum 26, driven by a hydraulic winch motor 28.

A pair of side squeeze arms 30 are pivotally mounted on vertical columns 32 on opposite sides of infeed ramp 18. These arms are rotated by piston rods in hydraulic cylinders 34 on main frame 10. The piston rods in these cylinders are connected to crank arms 36 on the squeeze arms. The outer ends of squeeze arms 30 are equipped with vertical feed rolls 38 driven by hydraulic motors 40.

A horizontal top feed roll 42 directly above infeed ramp 18 and driven by hydraulic motor 46 is carried by a pair of top squeeze arms 44 rotatable on a horizontal transverse shaft at 48. Squeeze arms 44 and feed roll 42 can be pressed down against an incoming log or its branches by a piston rod in a hydraulic cylinder 50, connected to a support bracket 52 on main frame 10.

An hour glass shaped horizontal feed roll 54 is driven by hydraulic motor 56 for sliding incoming logs on the floor plate 58. This feed roll is carried by a pair of hold-down arms 60 pivotally mounted at 48, and actuated by a piston rod in a hydraulic cylinder 62, carried by the support bracket 52.

For transportation and portability the main frame 10 is pulled as a trailer behind a towing vehicle. For this purpose a ball coupler assembly 64 is inserted into a ball coupler receptacle 66 and locked in place by a lock pin 68. Ball coupler receptacle 66 is mounted on an outside surface of one of the squeeze arms 30. In towing as a trailer the squeeze arms 30 are rotated to close against each other and infeed ramp 18 is rotated up against the bottom edges of the squeeze arms. This places ball coupler 64 approximately on the longitduinal center line of main frame 10.

Shear blade 70 is movable vertically by a piston rod in hydraulic cylinder 72 in a shear blade carriage frame 74. The shear blade has an arched knife edge 76 on its lower end which may be pushed down into a slotted anvil 78, at the level of floor plate 58. Shear blade carriage 74 is movable longitudinally in main frame 10 by a piston rod in hydraulic cylinder 80.

Figure 3:
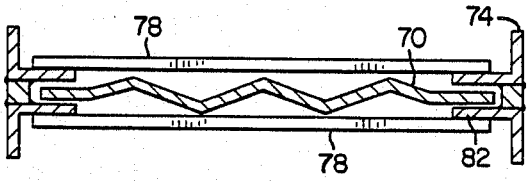
FIG. 3 is a sectional view on the line 3—3 in FIG. 2.

As seen in FIGS. 2 and 3 shear blade 70 is corrugated in a vertical direction for vertical stiffness and anvil plates 78 are spaced apart to receive the corrugated thickness of the blade. FIG. 2 shows the shear blade in raised position in solid lines and in broken lines in closed position with its knife edge at 76A below the top edges of the anvil plates. Thus when the shear blade is not entirely closed, for pulling the log as previously described, a major portion of the lower edge of the shear blade will be confined between anvil plates 78 to prevent horizontal bending of the blade.

Figure 4:
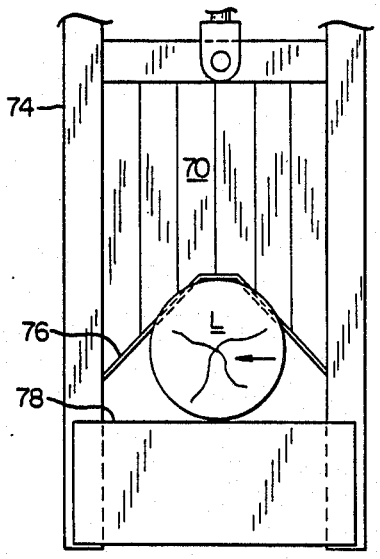
FIG. 4 is a view similar to FIG. 2 showing the cutting action on a single large log.
Figure 5:
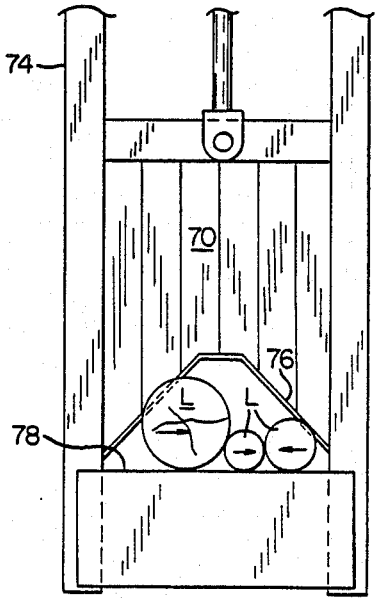
FIG. 5 is a similar view showing the cutting action on a group of medium and small logs.

The arched shape of the cutting edge of the sheet blade, curved in FIG. 1 and V-shape in FIG. 2, also is useful in centering the log during the operation of the shear blade. If a log L is disposed in an off-center position as shown in FIG. 2 when it enters the shearing assembly the arched shape of knife edge 76 will tend to center the logs as the shear blade starts to close, as shown in FIG. 4. This same centering action occurs when the shear blade closes on a group of logs in side-by-side relation as shown in FIG. 5.

Both the vertical stiffness and horizontal stiffness are ehanced by the arched shape of the lower edge of the blade because, as the blade descends, its side edge portions are supported against deflection by anvil plates 78 in addition to the support provided by vertical guide channels 82.

Another improvement in shear blade 70 is illustrated in FIGS. 6–9. FIG. 6 illustrates the shearing action of a conventional shear blade having a knife edge sharpened symmetrical with the center line as shown in FIG. 7. When shearing off short lengths of a log the shear blade bends toward the short end of the log because as the blade progresses downward through the log shear planes 84 develop in the short end because of the displacement of the thickness of the shear blade. The blade bends because there is virtually no resistance on the short log end side of the blade and full end grain resistance on the long end side.

This deflection is prevented by making the knife edge on the sear blade with 75% of the bevel on the short log end side and 25% of the bevel on the long log end side as shown in FIG. 9. Thus in a shear blade having a thickness T the dimension 86 of the bevel on the short long end side is 75% of thickness T and the dimension 88 of the bevel on the long log end side is 25% of thickness T. This proportion is found to balance forces on the shear blade so that it cuts straight through the log as seen in FIG. 8 instead of being deflected toward the short log end as in the case of the conventional shear blade in FIG. 6.

This type of shearing action decreases the drying time of the wood to that of conventionally sawed wood. The shear blade tends to shatter the end of the sheared piece, opening up the grain so a larger portion is exposed for drying.

Figure 10:
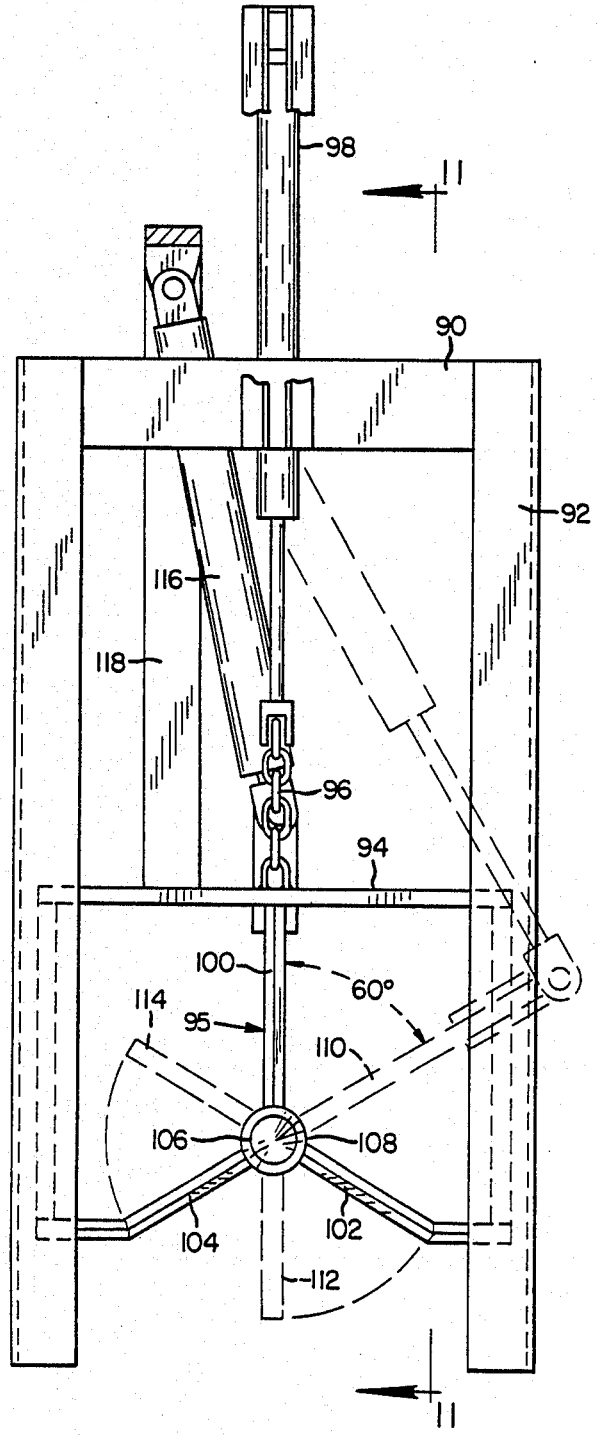
FIG. 10 is a front elevation view of the adjustable splitting head assembly.
Figure 11:
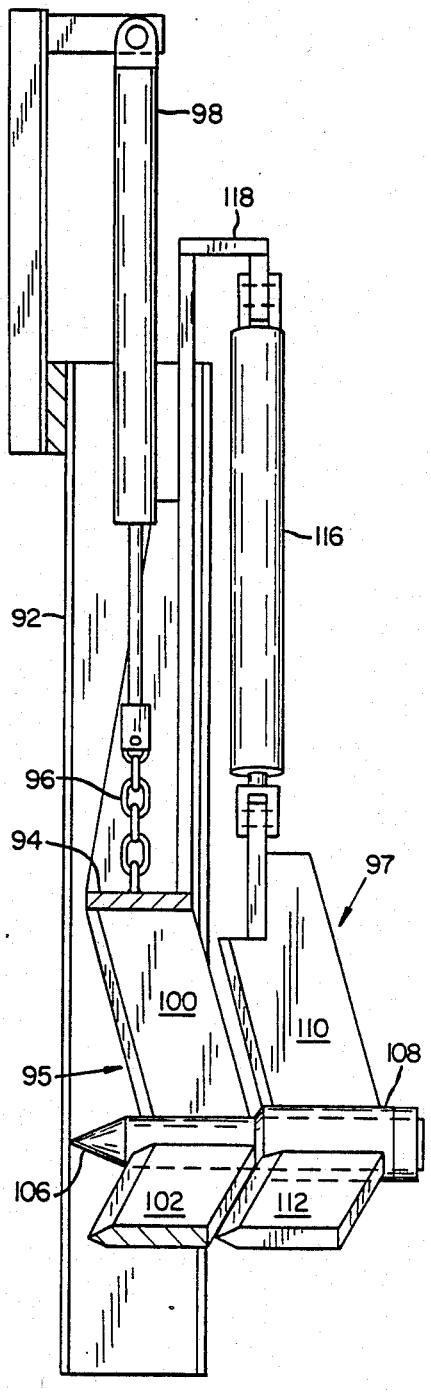
FIG. 11 is a sectional view on the line 11—11 in FIG. 10.
Figure 12:
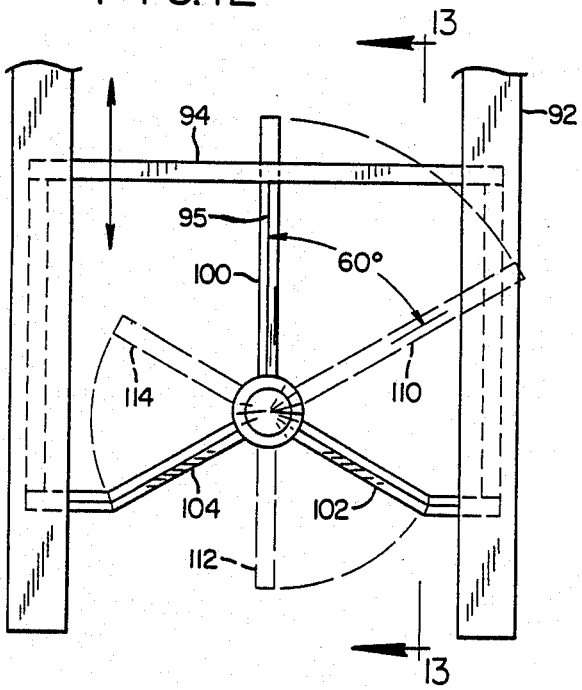
FIG. 12 is a view of a portion of FIG. 10.
Figure 13:
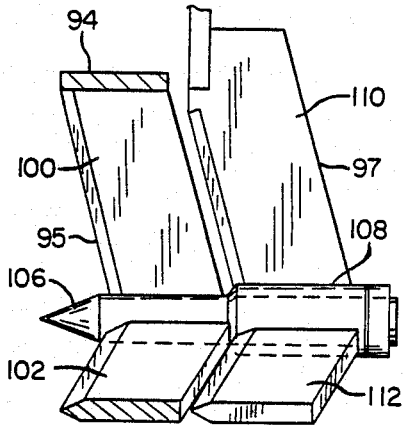
FIG. 13 is a sectional view on the line 13—13 in FIG. 12.

Referring back to FIG. 1, a splitting head assembly 90 is mounted on the rear end of main frame 10 behind the shear blade assembly. FIGS. 10–17 illustrate the construction and operation of the splitter head assembly. As seen in FIGS. 10 and 11 a stationary splitter head frame 92 contains a frame 94 which may be raised and lowered by a supporting chain 96 connected to a piston rod in hydraulic cylinder 98.

Fixedly mounted in movable frame 94 is a non rotatable splitter head 95 having three radial splitter blades 100, 102 and 104 disposed at 120 degree angles. A central hub 106 in this splitter head carries a pin or axle 108 having three radial splitter blades 110, 112, and 114 also disposed at 120 degree angles. This splitter head 97 may be rotated to a 60 degree angle by a piston rod in a hydraulic cylinder 116 mounted on a bracket 118 on frame 94.

Figure 14:
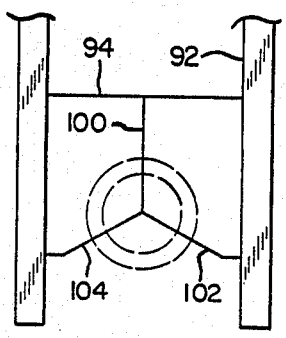
FIG. 14 is a diagrammatic view showing the splitter head adjusted for splitting a large log into three pieces.

Thus the splitter heads may be adjusted to split a log into two, three or six pieces as desired, depending on the size of the log. When the rotatable splitter head 97 is angularly aligned with the blades of the non rotatable splitter head 95, a log is split into three pieces as shown in FIG. 14. This may be accomplished on logs 8 inches in diameter to 12 inches in diameter.

Figure 15:
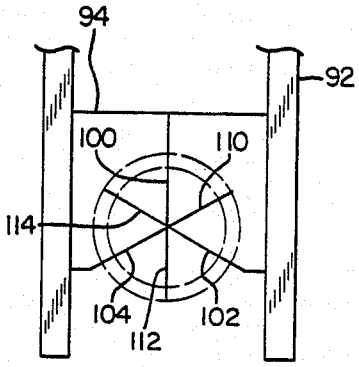
FIG. 15 is a similar view showing the splitter head adjusted for cutting a large log into six pieces.
Figure 16:
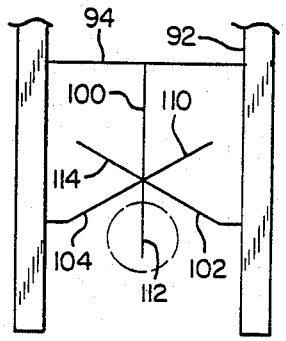
FIG. 16 is a similar view showing the splitter head adjusted for cutting a medium size log into two pieces.
Figure 17:
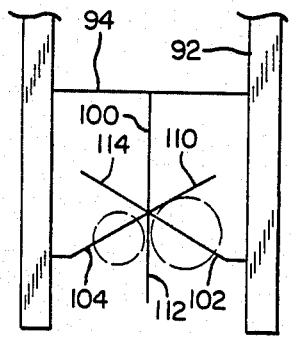
FIG. 17 is a similar view showing the splitter head adjusted for cutting a pair of logs into four pieces.

With the blades of the rotatable splitter head rotated to angles between the blades of the non rotatable splitter head, logs 13 through 16 inches in diameter may be split into six pieces as shown in FIG. 15. With the rotatable splitter head in the same position logs 7 inches in diameter and smaller may be split into two pieces as shown in FIG. 16. FIG. 17 illustrates a two-way split on two small logs, one being 5 inches in diameter and the other 7 inches in diameter for purpose of illustration. In performing these operations frame 94 is adjusted vertically as necessary.

Thus the machine will handle small logs with limbs to convert directly to firewood or hogged fuel, whichever is desired. The operator, at his option, can produce firewood out of a portion of a log which will make good firewood for a higher market value, and convert the rest of the log to hog fuel or wood chunks for commercial fuel.

Logs from six inch diameter to 16 inches diameter can be split to give a fairly uniform firewood piece size. This is very important when bundling wood in small packages for wood sales in super markets and other retail outlets. The machine provides a very positive feed system for irregular shaped logs and brush.

Sequences of operations of the equipment are initiated and terminated by a plurality of limit switches in FIG. 1. Limit switches LSD, LSA and LSC are mounted for vertical adjustment on a vertical support bracket 120 on shear blade carriage frame 74. Each switch has a horizontally projecting finger which is actuated by vertical movements of a horizontal actuating arm 122 on an upper part of the shear blade unit 70. In the upward and downward movements of the shear blade the actuating arm 122 deflects the movable switch finger on LSA sufficiently to move on past the switch if necessary.

In a similar manner a horizontal support bracket 124 on main frame 10 provides adjustable support for limit switches LSB and LSE, each having an upwardly actuating actuating finger in the path of a horizontal actuating switch arm 126, projecting laterally from the shear blade carriage frame 74.

Limit switch LSD controls the height or opening of the shear blade. It is manually adjustable to compensate for log size so that the shear blade will not open any wider than necessary to process the log presently in the machine.

Limit switch LSA controls the depth the shear blade penetrates the log before the splitting function starts. This switch should be set so that the shear blade stops with approximately three inches of vertical open space between the apex of arched cutting edge 76 and anvil 78.

Limit switch LSC controls the final depth of cut of the shear blade. This switch should be set so that the blade severs the log cleanly without bottoming out the shear blade cylinder 72.

Limit switch LSE is manually set to control the length of cut of the firewood block. It can be adjusted to cut blocks from 3 inches to 20 inches long.

Limit switch LSB controls the rearward travel of the shear blade carriage 74. It should be set so the carriage 74 stops just before the piston in cylinder 80 bottoms out. Once properly set, this switch should be not have to be moved.

Figure 18:
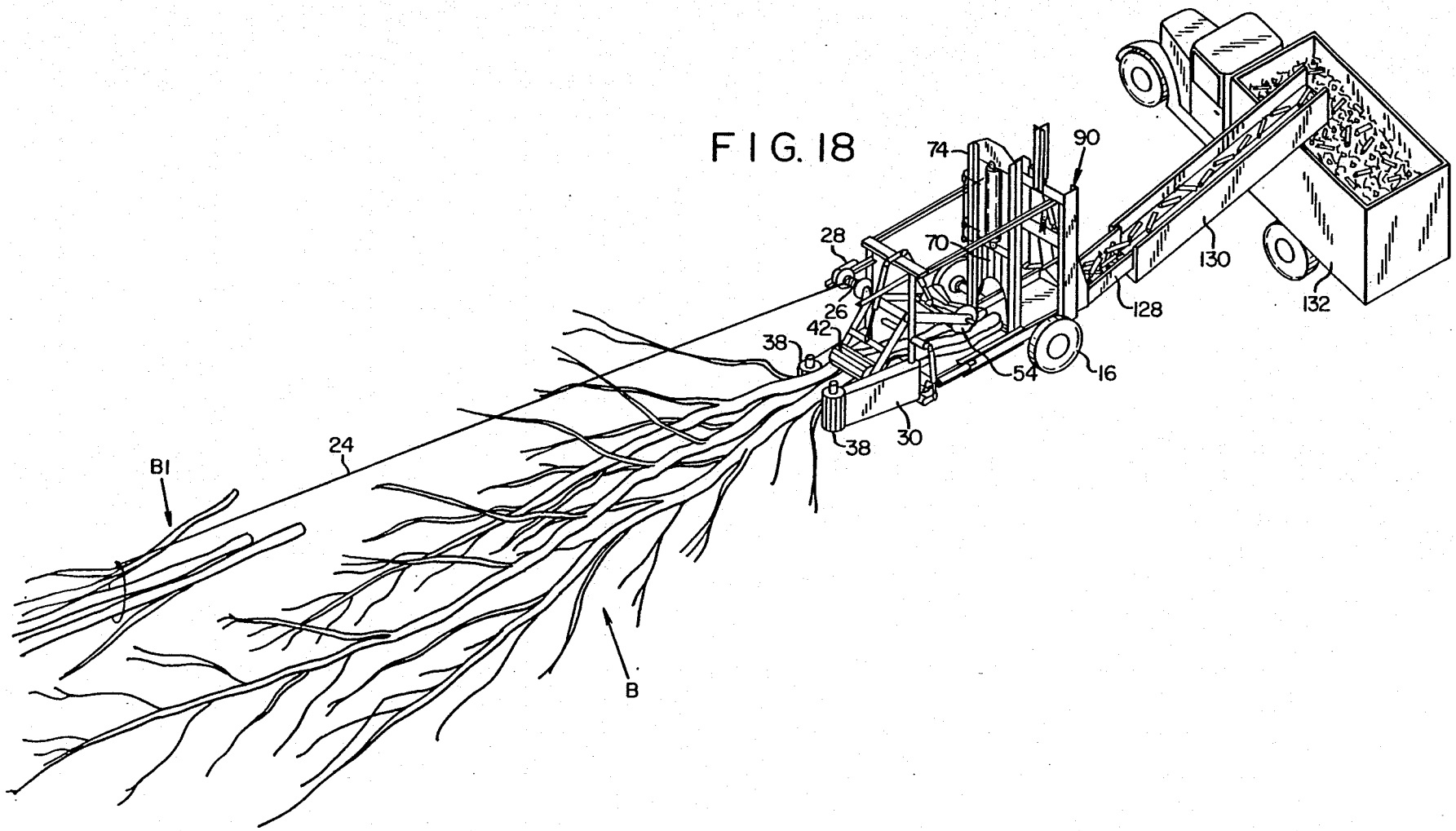
FIG. 18 is a perspective view illustrating the operations involved in cutting a tree or group of trees into hog fuel.

Before describing the details of the electric and hydraulic systems, a general description of the operation is provided with reference to FIG. 18. This illustrates a typical operation where a number of small logs are bundled together by winch cable 24 and pulled into the machine as previously mentioned in connection with FIGS. 5 and 17. These logs usually retain branch limbs and as one bundle B advances through the machine the winch line 24 is fastened to the next bundle B1. This makes it possible for bundles to be fed end to end, one after another, with a single operator.

Each time shear blade carriage 74 moves towards splitter head assembly 90 all the feed rolls are actuated by hydraulic motors 40, 46 and 56 in FIG. 1. The squeeze cylinders 34, 50 and 62 are allowed to have a climbing feed effect since they are hydraulically connected to the return line of cylinder 80. If they tend to open, air is taken in the system through a check valve to be described.

When the shear blade carriage 74 returns to the start position the squeeze rolls are hydraulically locked and the squeeze cylinders 34, 50 and 62 apply force to the incoming logs by using the pressure on cylinder 80. This force breaks limbs and compresses log bundles for feed into the machine and it also holds the logs from sliding back toward the infeed of the machine when the shear blade carriage 74 is returning to the forward start position.

Figure 19:
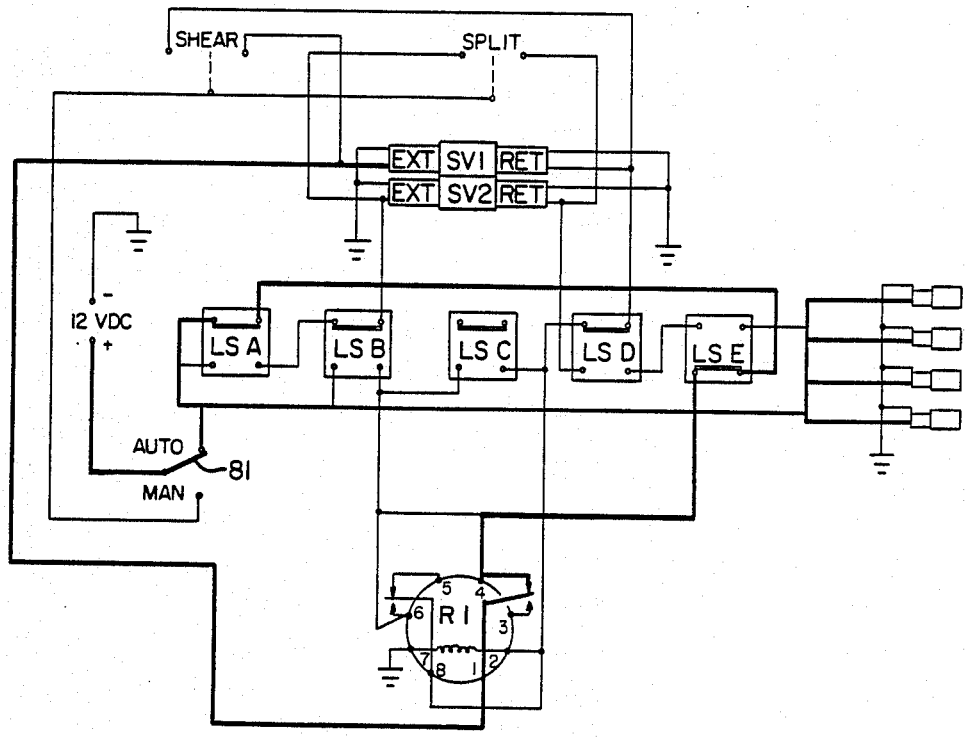
FIGS. 19 to 28 are schematic diagrams of the electrical and hydraulic systems showing in heavy lines the active parts of the systems in a series of sequences of operations in automatic operation as described.
Figure 24:
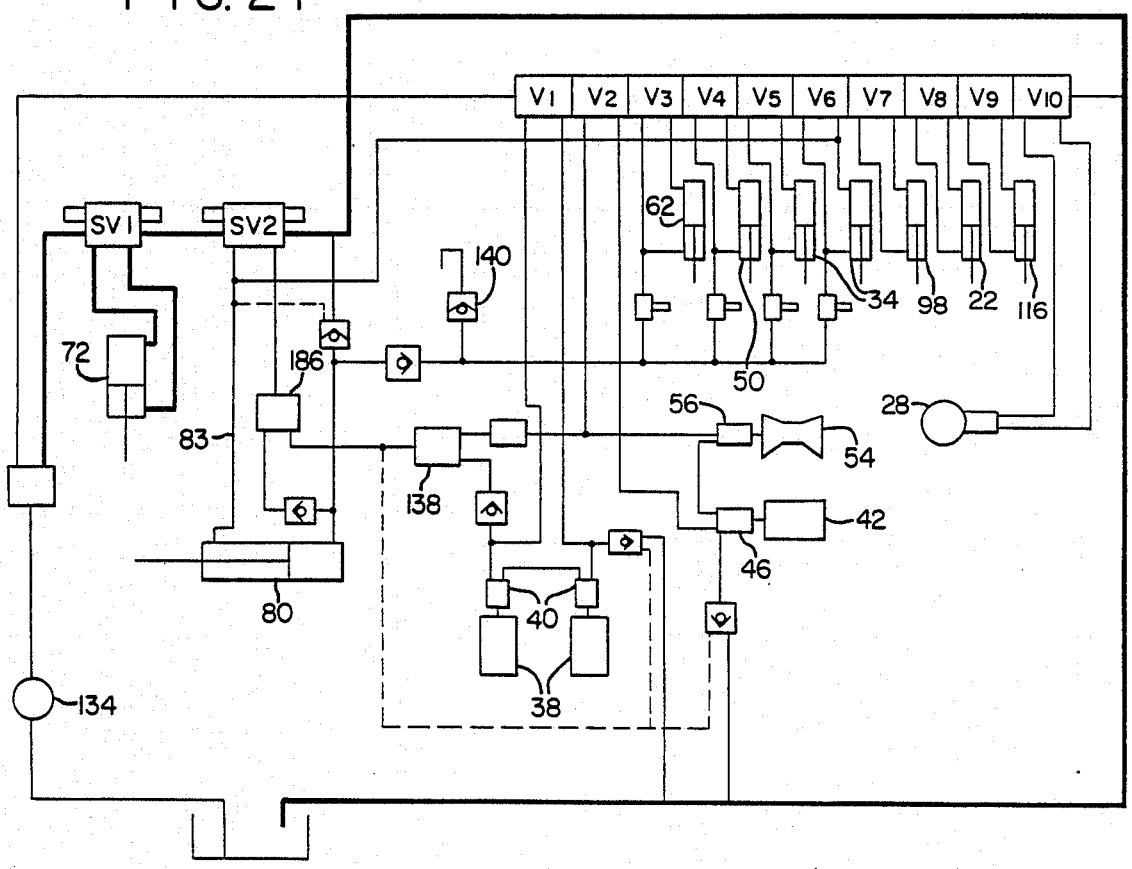

Sequence No. 1. Solenoid valve SV1 (extend) (FIG. 19) is actuated through limit switches LSA and LSE and relay R1 after manual switch 81 is closed. This allows oil from pump 134 to enter the shear cylinder 72 in FIG. 24 which starts the shear blade 70 down through the log.

Figure 20:
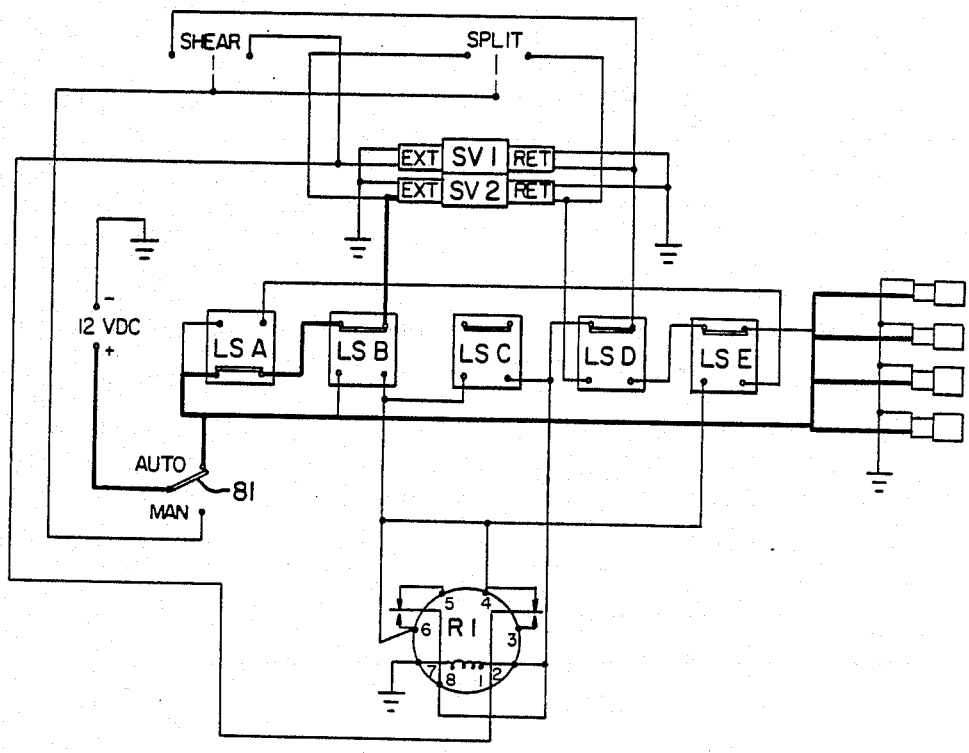
Figure 25:
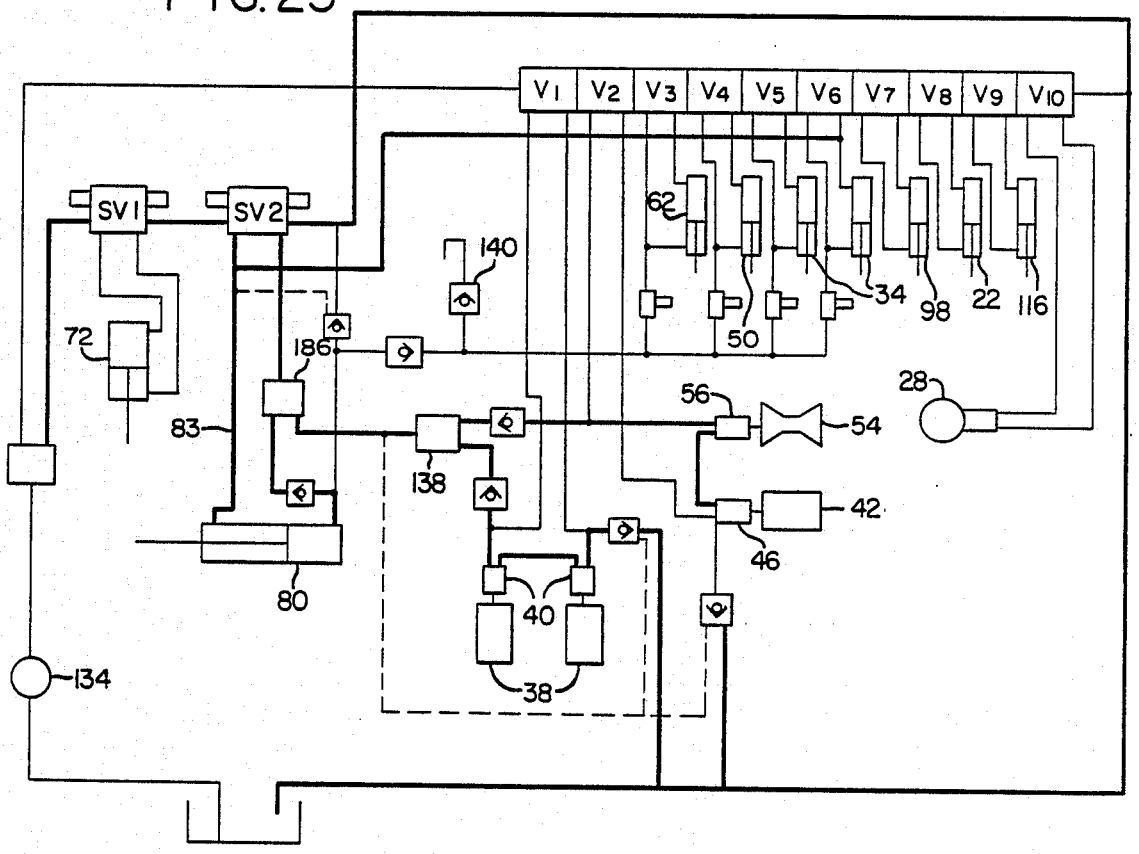

Sequence No. 2. Solenoid valve SV2 (extend) is actuated through limit switches LSA and LSB (FIG. 20). This allows oil to enter the flow control valve 186 in FIG. 25 which divides the flow with a portion of the flow going to shear blade frame carriage hydraulic cylinder 80. This moves the carriage toward the splitter head assembly 90 at the rear of the machine.

At the same time the other portion of the flow from valve 136 is diverted to the flow divider 138 which in turn feeds oil equally to feed roll hydraulic motors 46, 56 and 40. Flow control valve 186 is manually set so the rotational distance travelled on the feed rolls is equal to the distance travelled by shear blade carriage 74, controlled by cylinder 80.

While this is happening it is possible that limbs, knots etc. will be pulled under the feed rolls tending to open or raise them. Cylinders 34, 50 and 62 control the pressure on the feed rolls. If they tend to retract, oil is allowed to flow back into the return line 83 of cylinder 80. To break the hydraulic lock air is allowed into cylinders 34, 50 and 62 through check valve 140.

Figure 21:
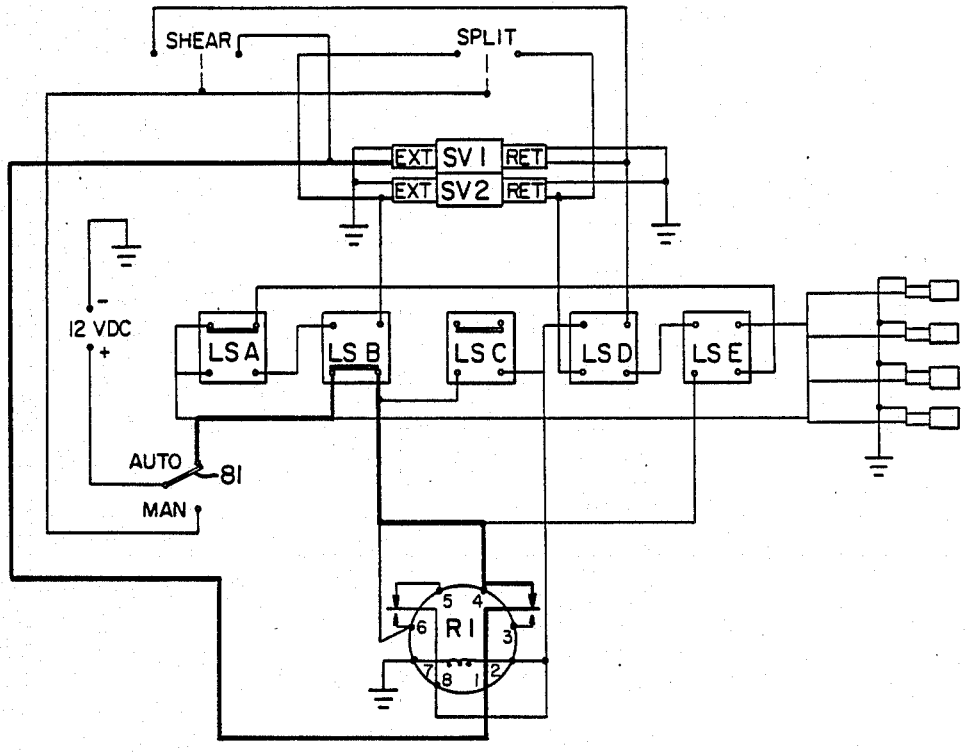
Figure 26:
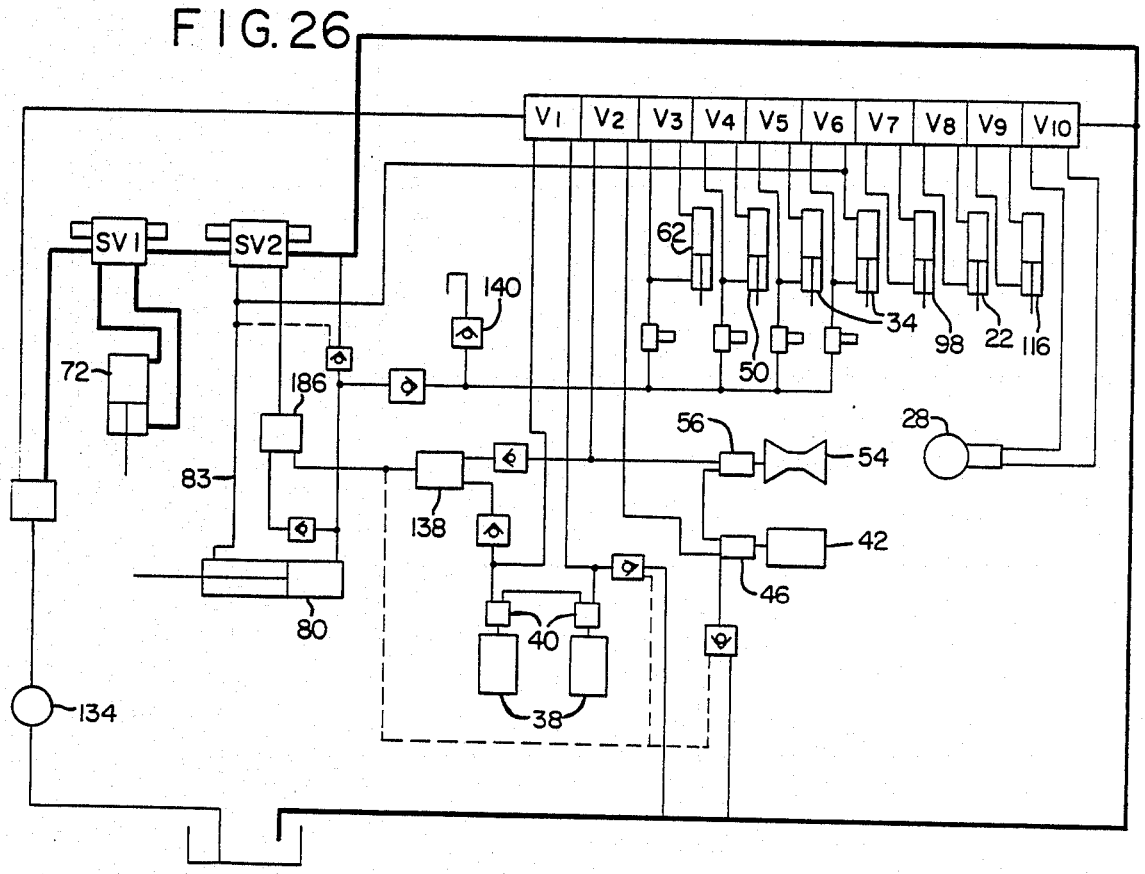

Sequence No. 3. Solenoid valve SV1 (extend) is actuated through limit switch LSB and relay R1 in FIG. 21. This allows oil to flow to shear cylinder 72 in FIG. 26 which pushes the shear blade through the log finishing the cut.

Figure 22:
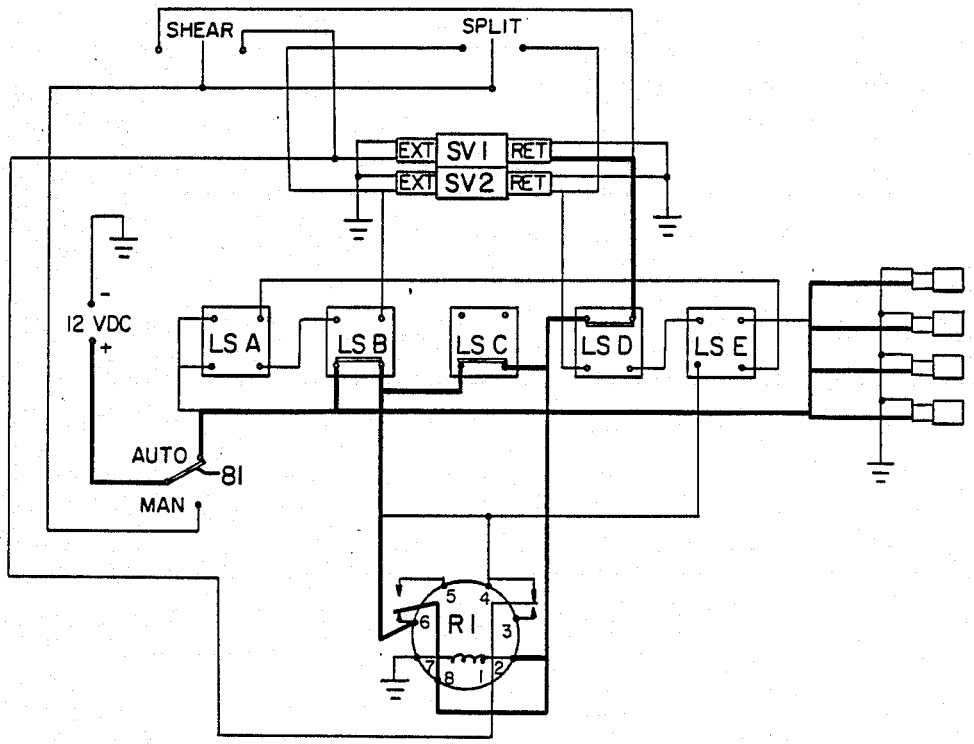
Figure 27:
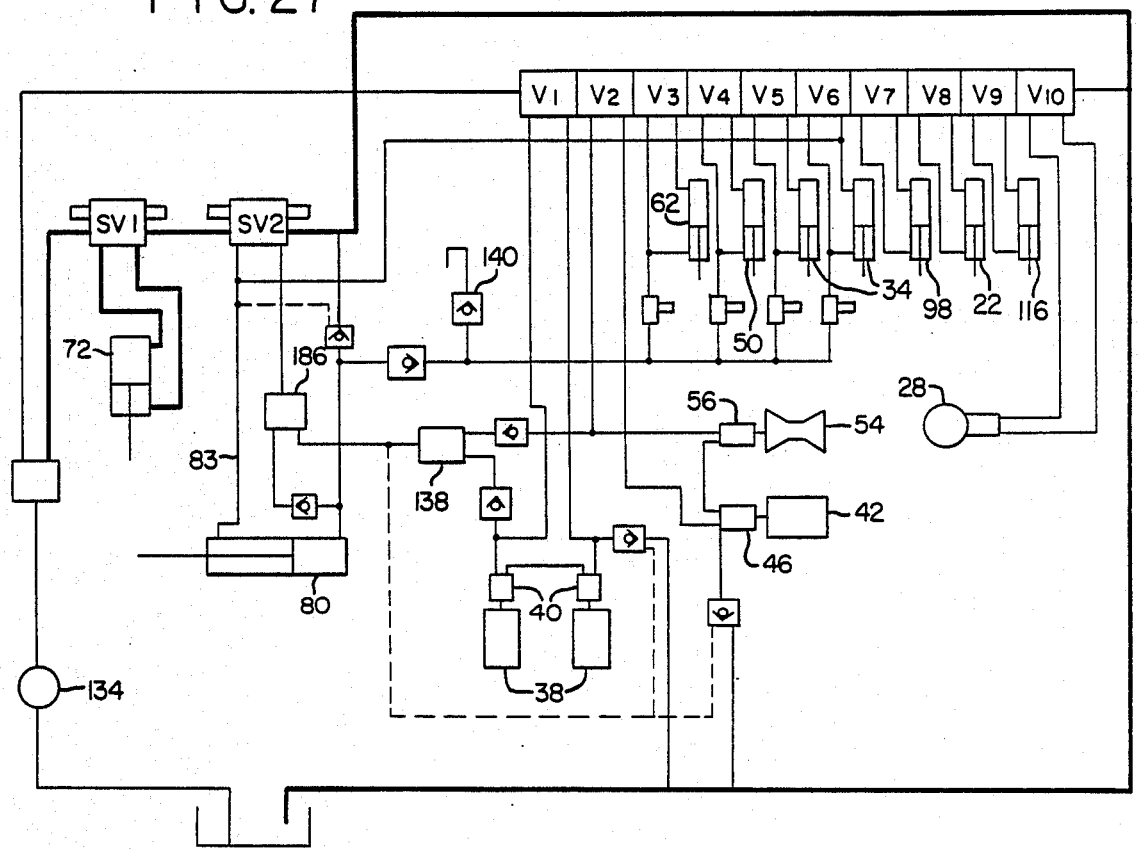

Sequence No. 4. Solenoid valve SV1 (retract) is actuated through limit switches LSB, LSC, LSD and relay R1 in FIG. 22. This allows oil to flow to shear cylinder 72 in FIG. 27 which opens the shear blade to its most open position.

Figure 23:
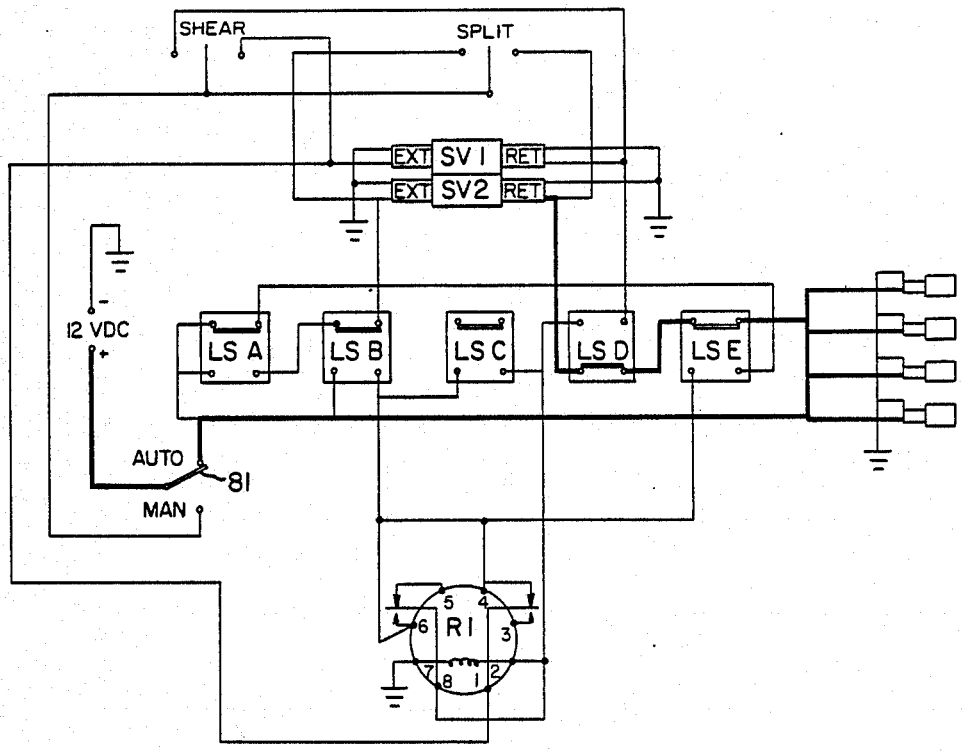
Figure 28:
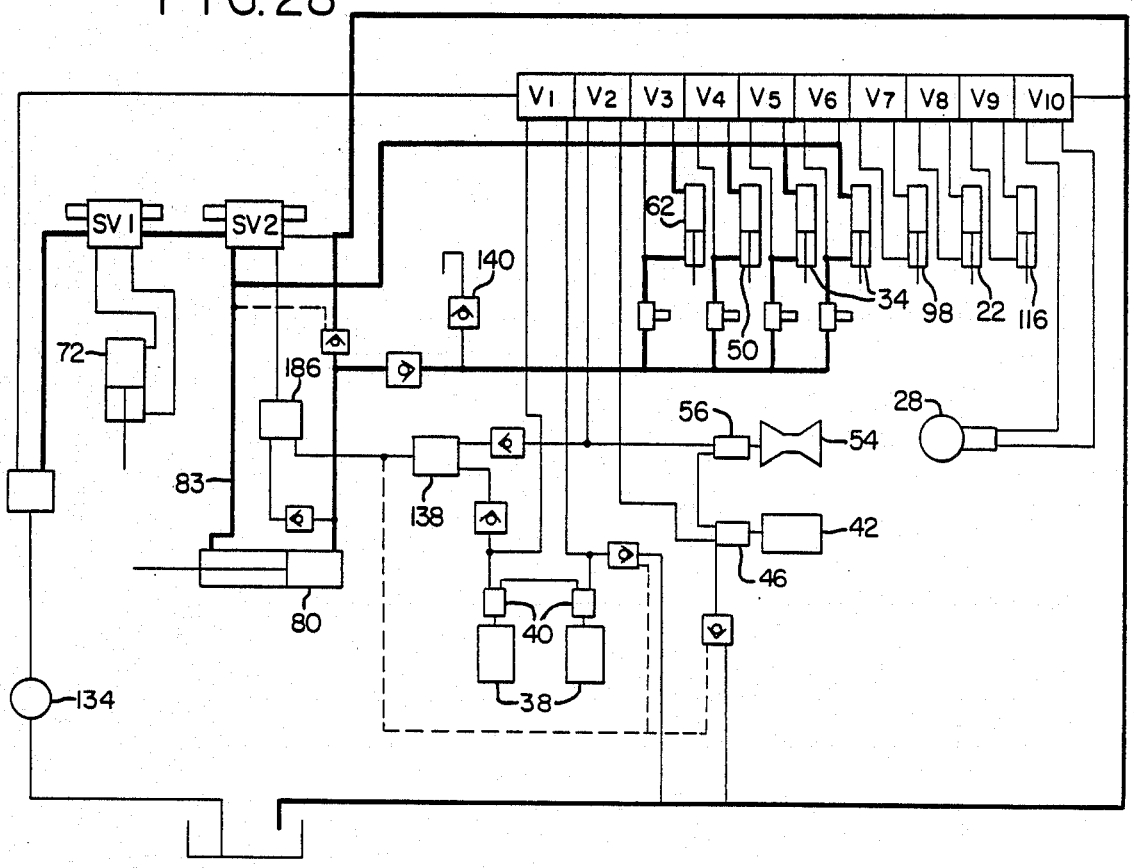

Sequence No. 5. Solenoid valve SV2 (retract) is actuated by limit switches LSD and LSE in FIG. 23. This allows oil to flow to cylinder 80 in FIG. 28 which in turn returns shear blade carriage 74 to its starting position and also feeds oil to the feed roll cylinders 34, 50 and 62 which will collapse and crush any limbs and brush bundles which may be under the rolls 38, 42 and 54. Since all the hydraulic motors 40, 46 and 56 are locked hydraulically they prevent the log, brush or bundle of logs from being pushed toward the infeed of the machine while the shear blade carriage 74 is returning to the starting position.

When the cut pieces are relatively short the output end of the main frame is equipped with an outfeed chute 128 which discharges the wood onto a belt conveyor 130 leading to a vehicle 132 as shown in FIG. 18.

Each time the shear blade carriage moves toward the splitter head, all the feed rolls are actuated by their hydraulic motors 40, 46, and 56. The squeeze cylinders 34, 50, and 62 are allowed to have a climbing feed effect since they are hydraulically connected to the return line of cylinder 80. If the squeeze cylinders tend to open, air is taken into the system through check valve 140.

As the sheer blade carriage returns to the start position the squeeze rolls are hydralically locked and the squeeze cylinder 34, 50, and 62 apply force to the incoming log or logs by using the pressure in cylinder 80. This force breaks limbs and compresses log bundles for feed into the machine; it also holds the logs from sliding back toward the infeed of the machine when the shear blade carriage is returning to the start position.

The most important use of the machine is to convert the material usually burned in slash fires after logging operations into useable energy. There is no other economical way at the present time to do this. Other important uses are in fruit and nut orchards, tree farms and by municipalities and tree service companies to make a useable product out of tree thinnings, trimmings and brush.

What is claimed is:

1. A wood/log processing machine comprising an elongated main frame having an input end and an output end, a shear blade carriage movable along said main frame, a shear blade mounted in said shear blade carriage transverse to said main frame, means for advancing said shear blade less than entirely through a log in said main frame leaving the leading end of the log connected to its trailing end, power operated means to move said shear blade carriage away from the input end of said main frame to advance the log along said main frame, a pair of said squeeze arms on opposite sides of said input end of said main frame having power operated vertical feed rolls, a top squeeze arm on said input end of said main frame having a power operated horizontal feed roll, a power operated horizontal hold down feed roll in said main frame on the input side of said shear blade, and means to complete the advance of said shear blade entirely through the log to shear off said leading end.

2. A machine as defined in claim 1 including a power operated adjustable infeed ramp supporting the infeed end of said main frame at adjustable height to inpart an inclination to said main frame comforming to the inclination of a log in process, and wheels supporting the outfeed end.

3. A machine as defined in claim 2 including a ball coupler receptacle on one of said side squeeze arms for towing the machine on said wheels.

4. A machine as defined in claim 1, said hold down feed roll having an hourglass shape.

5. A machine as defined in claim 1 including individual hydraulic motors for driving all of said feed rolls.

6. A machine as defined in claim 5 including means for actuating said motors when said shear blade carriage is moved away from said input end of said main frame.

7. A machine as defined in claim 5 including means for locking said motors against rotation when said shear blade carriage is moved toward said input end of said main frame.

8. A machine as defined in claim 1 including hydraulic cylinders for applying force on said squeeze arms, and means for relieving said force when said shear blade carriage is moved away from said input end of said main frame, allowing the feed rolls to have a climbing effect on branches and irregularities in the log.

9. A machine as defined in claim 1, said shear blade having corrugations parallel to its direction of movement in said shear blade carriage for longitudinal stiffness.

10. A machine as defined in claim 1, said shear blade having an arched cutting edge.

11. A machine as defined in claim 1, said shear blade having a bevelled knife edge with approximately 25% of the bevel on the input side of the blade and approximately 75% of the bevel on the output side.

12. A machine as defined in claim 1 including an adjustable splitter head assembly on the output end of said main frame behind said shear blade.

13. A machine as defined in claim 12 including means to raise and lower said splitter head assembly.

14. A machine as defined in claim 12, said splitter head assembly comprising a first set of radial blades in fixed angular positions and a second set of radial blades having rotational adjustment behind said first set of blades.

15. In a wood/log processing machine, a vertical frame, and a splitter head assembly movable vetically in said frame, said assembly comprising a first splitter head having radial blades in fixed angular positions and said assembly including a second splitter head behind said first splitter head, said second splitter head having rotatable radial blades mounted therein.

16. A splitter head assembly as defined in claim 15 including power means for raising and lowering said assembly in said frame, and power means for rotating said second splitter head to place its blades in alignment with the blades of said first splitter head or in angular positions between the blades of said first splitter head.

17. A splitter head assembly as defined in claim 16, each splitter head having three radial blades.

18. In a wood/log processing machine, a vertical shear blade frame, and a power operated vertically corrugated shear blade movable vertically in said frame.

19. A shear blade as defined in claim 18 having an arched cutting edge on the lower end of said blade.

20. A shear blade as defined in claim 18 said cutting edge being a bevelled knife edge on said blade with approximately 25% of the bevel on the wood/log input side of said blade and approximately 75% of the bevel on the output side.

* * * * *

UNITED STATES PATENT AND TRADEMARK OFFICE

CERTIFICATE OF CORRECTION

PATENT NO. : 4,805,676

DATED : February 21, 1989

INVENTOR(S) : Warren A. Aikins

It is certified that error appears in the above-identified patent and that said Letters Patent is hereby corrected as shown below:

Column 3, line 59 change "ehanced" to --enhanced--.

Column 4, line 9, change "sear" to --shear--.

Column 5, lines 19 and 20 change "actuating actuating" to --projecting actuating--.

Column 7, line 26 (claim 1) change "said" to --side--.

Signed and Sealed this

Eleventh Day of July, 1989

*Attest:*

*Attesting Officer*

DONALD J. QUIGG

*Commissioner of Patents and Trademarks*